US009572405B2

(12) United States Patent
Saris

(10) Patent No.: US 9,572,405 B2
(45) Date of Patent: Feb. 21, 2017

(54) FASTENING MECHANISM FOR ICE SKATES

(71) Applicant: David Gerard Saris, Leamington (CA)

(72) Inventor: David Gerard Saris, Leamington (CA)

( * ) Notice: Subject to any disclaimer, the term of this patent is extended or adjusted under 35 U.S.C. 154(b) by 146 days.

(21) Appl. No.: 14/662,034

(22) Filed: Mar. 18, 2015

(65) Prior Publication Data

US 2016/0270483 A1 Sep. 22, 2016

(51) Int. Cl.
*A43C 11/00* (2006.01)
*A43C 11/14* (2006.01)

(52) U.S. Cl.
CPC ..... *A43C 11/004* (2013.01); *A43C 11/1413* (2013.01); *Y10T 24/2106* (2015.01); *Y10T 24/2183* (2015.01)

(58) Field of Classification Search
CPC ..... A43C 11/004; A43C 11/1413; Y10T 24/2183; Y10T 24/2106
See application file for complete search history.

(56) References Cited

U.S. PATENT DOCUMENTS 2,215,221 A * 9/1940 Levine ..... A43C 11/1406 24/70 R
3,546,751 A * 12/1970 Baso ..... A43C 11/1406 24/70 SK
3,561,067 A * 2/1971 Baso ..... A43C 11/1406 24/70 SK
3,562,872 A * 2/1971 Haubensack ..... A43C 11/1406 24/70 SK
3,599,296 A * 8/1971 Baso ..... A43C 11/1413 24/70 SK
3,600,761 A * 8/1971 Mathey ..... A43C 11/1413 24/61
3,601,865 A * 8/1971 Schoch ..... A43C 11/1413 24/69 SK
3,654,670 A * 4/1972 Baso ..... A43C 11/1413 24/70 SK
3,662,435 A * 5/1972 Allsop ..... A43C 11/1413 24/70 SK
4,150,500 A * 4/1979 Delery ..... A43C 11/1413 24/71 SK
4,310,951 A * 1/1982 Riedel ..... A43C 11/1413 24/68 SK
4,761,898 A * 8/1988 Courvoisier ..... A43C 11/1413 24/68 SK (Continued)

*Primary Examiner* — Robert J Sandy
*Assistant Examiner* — Louis Mercado

(57) ABSTRACT

A securing device for attaching hockey skates to a foot. The device includes a series of fastening mechanisms distributed about the shoe along the length of the tongue. The series of fastening mechanisms provides protection and mobility for the foot. Each fastening mechanism includes a buckle, a receiving lip, an insertion lip, a pivot plate, a mounting plate, and an engagement strip. The mounting plate and the engagement strip are integrated into the shoe. The buckle is attached to the mounting plate through the pivot plate and includes a top surface, a bottom surface, a first cavity, a first plurality of teeth, and a locking hook. The buckle may be affixed to the engagement strip through the engagement of the first plurality of teeth and the engagement strip. The buckle may be secured into a locked configuration with the positioning of the locking hook into the keeper indentation.

20 Claims, 8 Drawing Sheets

(56) References Cited

U.S. PATENT DOCUMENTS

| | | | | | |
|---|---|---|---|---|---|
| 5,606,779 | A * | 3/1997 | Lu | A43C 11/146 | 24/68 SK |
| 5,745,959 | A * | 5/1998 | Dodge | A43C 11/00 | 24/68 SK |
| 6,324,735 | B1 * | 12/2001 | Chen | A43B 3/0063 | 24/68 SK |
| 6,347,436 | B1 * | 2/2002 | Barber | A43C 1/00 | 24/68 SK |
| 6,374,464 | B1 * | 4/2002 | Lai | A43C 11/1406 | 24/68 SK |
| 6,536,138 | B1 * | 3/2003 | Miralles | A43B 5/0415 | 24/70 SK |
| 6,554,297 | B2 * | 4/2003 | Phillips | A43C 11/1413 | 24/68 SK |
| 6,729,047 | B2 * | 5/2004 | Hirayama | A43B 3/0031 | 24/68 SK |
| 7,603,795 | B2 * | 10/2009 | Pallatin | A43B 5/0415 | 24/68 SK |
| 7,866,065 | B2 * | 1/2011 | Munns | A43B 5/145 | 24/68 SK |
| 2001/0013157 | A1 * | 8/2001 | Giancarlo | A43B 1/0027 | 24/71 SK |
| 2003/0019081 | A1 * | 1/2003 | Livingston | A43C 11/1406 | 24/68 R |
| 2004/0148741 | A1 * | 8/2004 | Hsiao | A43C 11/1406 | 24/68 SK |
| 2013/0047388 | A1 * | 2/2013 | Kavarsky | A43C 11/1413 | 24/68 K |
| 2015/0359298 | A1 * | 12/2015 | Munns | A43B 5/145 | 36/131 |

* cited by examiner

SECTION A-A

FASTENING MECHANISM FOR ICE SKATES

FIELD OF THE INVENTION

The present invention relates generally to securing mechanisms for footwear. More specifically, the present invention is a fastening mechanism for hockey skates that increases physical protection without sacrificing mobility of the foot of the user.

BACKGROUND OF THE INVENTION

The present invention is an alternative fastening mechanism for footwear, in particular for sport shoes such as hockey skates. Traditional hokey skates use shoelaces to secure the shoe to the user's foot, a means that has not changed in over 100 years other than bulky general buckles used mainly for kids' skates. Especially in hockey, shoelaces do not provide adequate protection and comfort. Traditional shoelaces are composed of strands of synthetic fibers and as such provide little to no physical protection to the foot of the wearer against pucks, sticks, or blades. Additionally, tying shoelaces to proper tightness is also quite difficult and as a result, time consuming for the wearer. If the shoelaces are tightened too much, then pressure points along the foot may develop and cause improper blood circulation. If the shoelaces are too loose, then the wearer's athletic performance may suffer because the shoe gives, bends, or shifts too much on the foot. Additionally, synthetic fibers are by nature slippery and often times cause the shoelaces to come undone when experiencing minor fluctuations in tension caused by the wearer's skating. This is especially problematic if the wearer is wearing gloves, as is the case in hockey because it will result in a significant downtime for the wearer while he skates off the ice to retie his shoes.

The present invention provides a solution to the aforementioned problems with traditional fastening mechanisms. The present invention is a plurality of overlapping buckles which runs along the length of the tongue, similar to a traditional shoelace configuration. The present invention is easier to fasten and adjust than shoelaces. The overlapping configuration of the present invention provides significantly better protection for the feet. Furthermore, because the individual components are not linked to each other the wearer may adjust the tightness to his or her comfort level and in turn promote proper blood circulation in the foot.

DETAIL DESCRIPTIONS OF THE INVENTION

All illustrations of the drawings are for the purpose of describing selected versions of the present invention and are not intended to limit the scope of the present invention.

The present invention is a fastening device for footwear, in particular hockey skates. The present invention provides a fast and easy means for fastening hockey skates to the foot of the wearer. The individual buckle design allows for the wearer to tighten various sections of the foot properly such that pressure points do not develop; pressure points may lead to improper blood circulation. The present invention may be utilized with various types of footwear including, but not limited to, work boots, ski boots, hockey skates, and ice skates.

Figure 7:
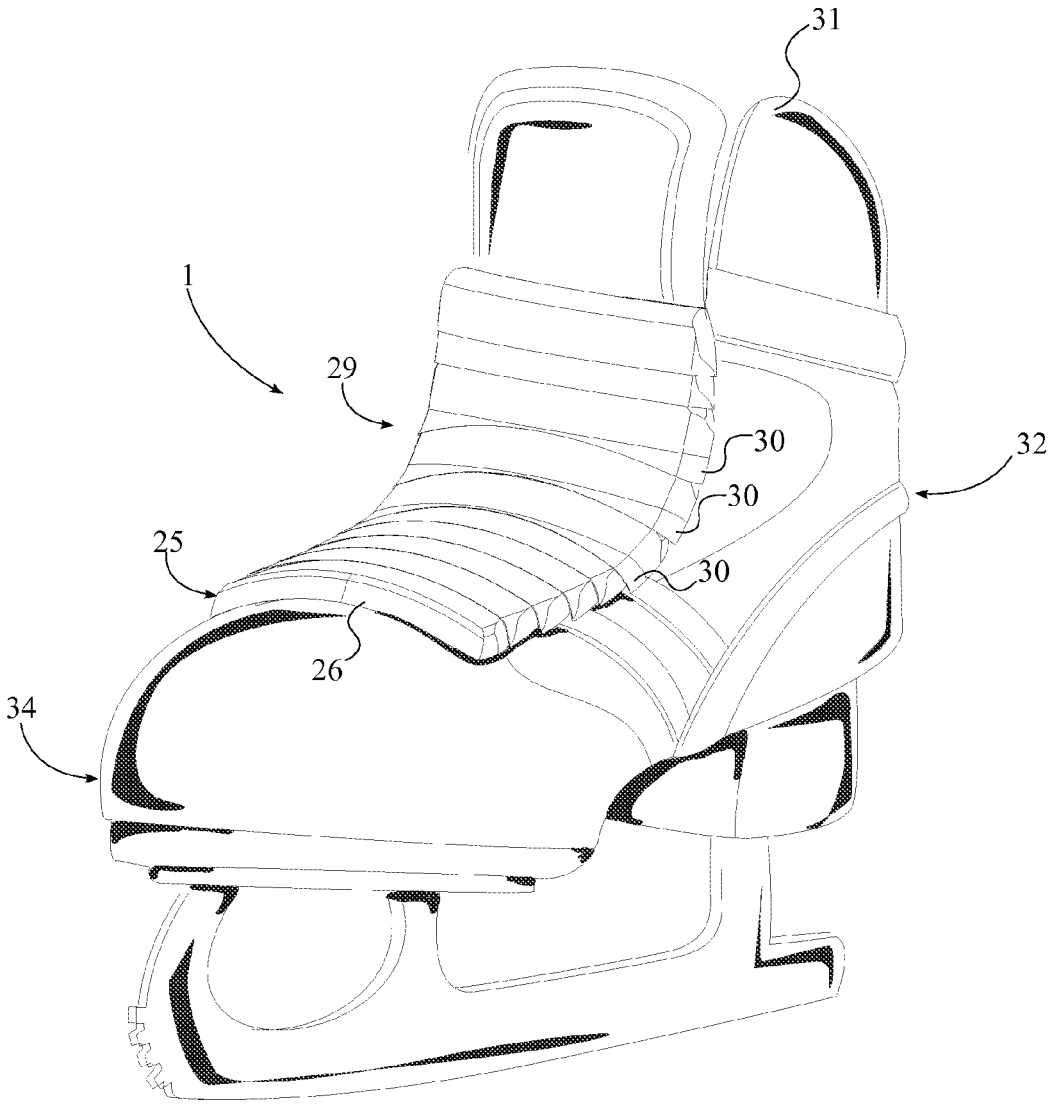
FIG. 7 is a perspective view of the present invention integrated into a hockey skate shoe.

Referring to FIG. 7, the present invention comprises a series of fastening mechanisms 1 distributed along the top of a shoe 31. More specifically, the series of fastening mechanisms 1 is spaced along a tongue of the shoe 31 and attached to either side of a shoe upper where eyelets for shoelaces would traditionally be positioned. Each from the series of fastening mechanisms 1 comprises a mounting plate 17, an engagement strip 21, a buckle 2, a pivot plate 10, a receiving lip 8, and an insertion lip 9. The mounting plate 17 is integrated into a first side of the shoe upper and comprises a pivot-receiving cavity 18 and a keeper indentation 19. The keeper indentation 19 and the pivot-receiving cavity 18 are positioned opposite to each other across the mounting plate 17 and allow the buckle 2 to attach to the mounting plate 17. The engagement strip 21 is integrated into a second side of the shoe upper, located opposite the first side with the tongue positioned in between. The buckle 2 engages the mounting plate 17 and the engagement strip 21 to physically connect and bring the first side and the second side of the shoe upper together. This configuration constricts the shoe upper around the foot and in turn secures the shoe 31 to the foot.

Figure 1:
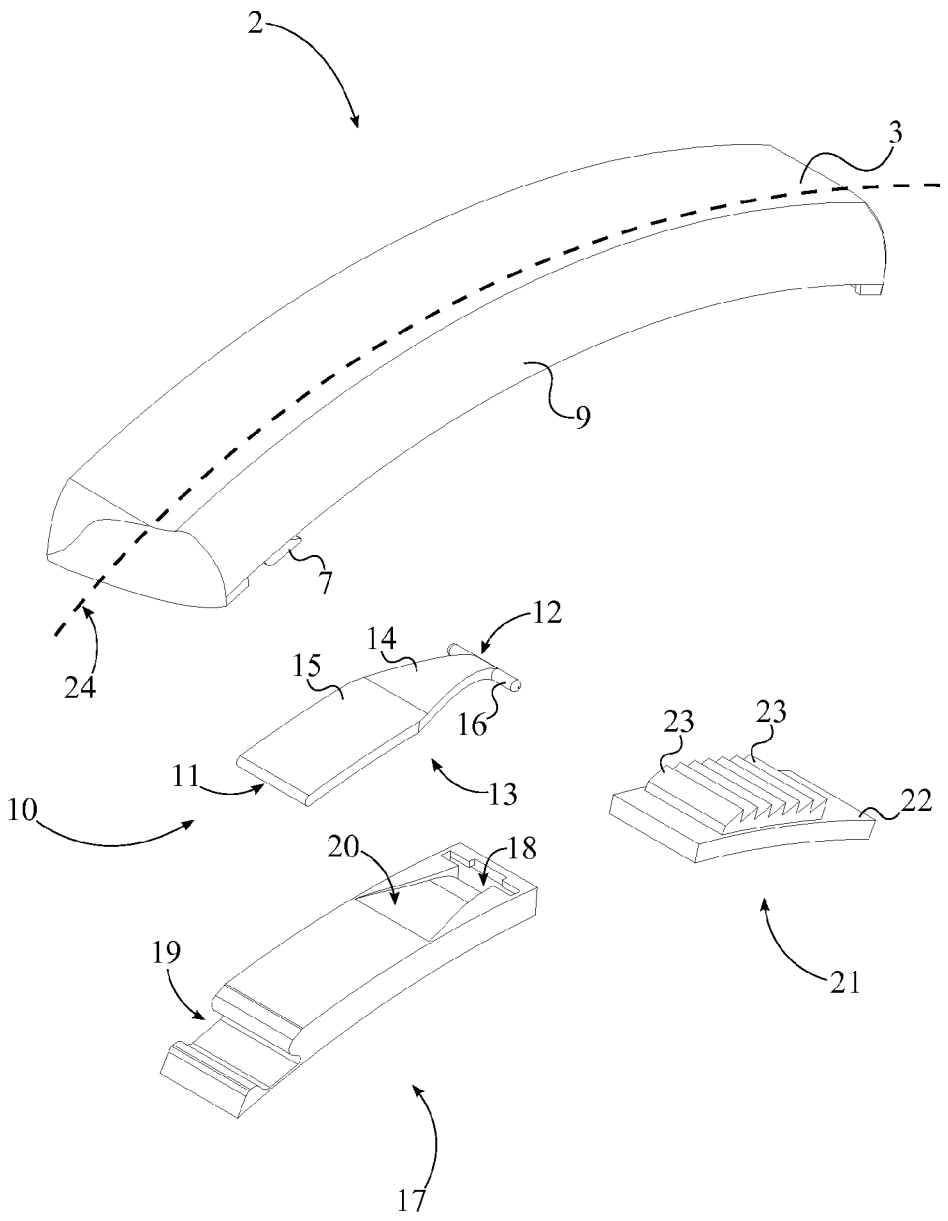
FIG. 1 is an exploded perspective view of a fastening mechanism.
Figure 2:
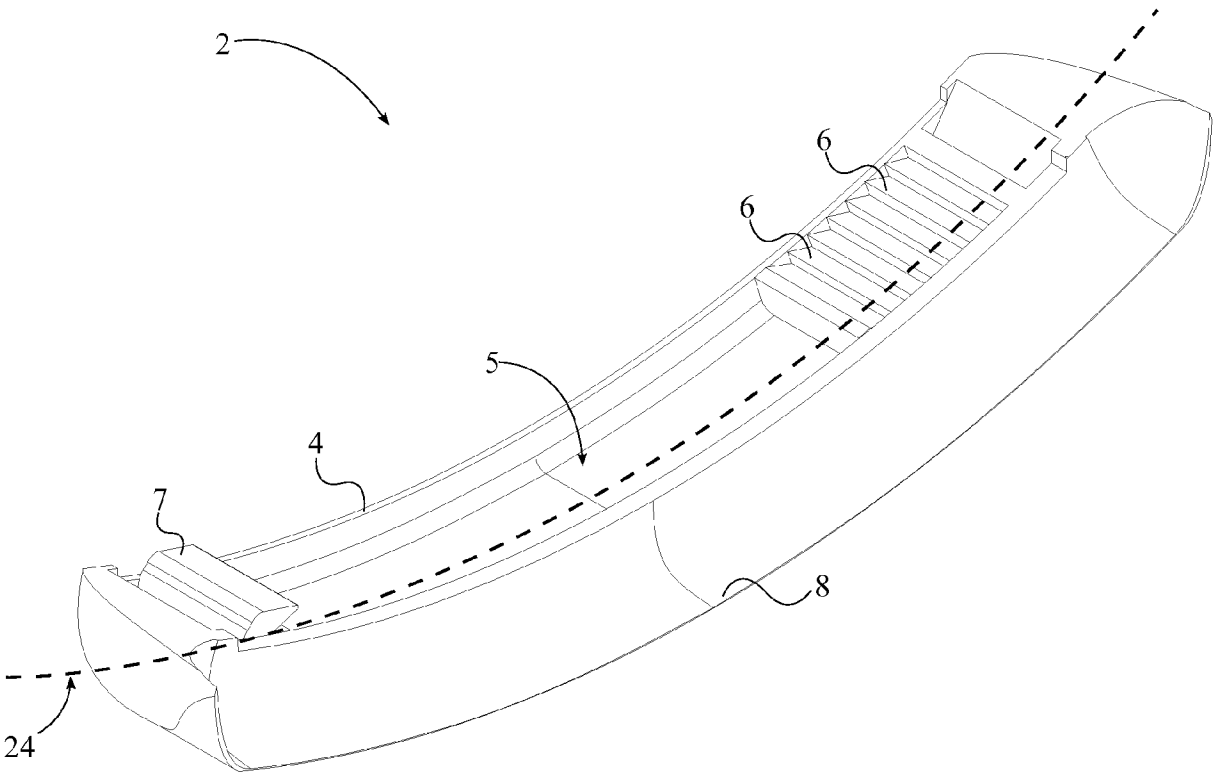
FIG. 2 is a bottom perspective view of a buckle of the fastening mechanism.

The buckle 2 comprises a top surface 3, a bottom surface 4, a first cavity 5, a first plurality of teeth 6, and a locking hook 7 as seen in FIGS. 1-2. The first cavity 5 traverses into the buckle 2 from the bottom surface 4 and allows the buckle 2 to sit flush with the outer surface of the shoe upper. The first plurality of teeth 6 is positioned within the first cavity 5 and allows the buckle 2 to attach to the engagement strip 21. Similarly, the locking hook 7 is positioned within the first cavity 5 and allows the buckle 2 to attach to the mounting plate 17. The first plurality of teeth 6 and the locking hook 7 are positioned opposite to each other along the buckle 2, such that one end of the buckle 2 attaches to the first side of the shoe upper and the other end attaches to the second side of the shoe upper. The pivot plate 10 acts as a tensioner for the fastening mechanism and applies sufficient force on the buckle 2 to prevent accidental disengagement. The pivot plate 10 comprises a first end 11 and a second end 12. The first end 11 is pivotably attached within the first cavity 5, adjacent to the locking hook 7. The second end 12 is pivotably engaged to the pivot-receiving cavity 18.

Figure 6:
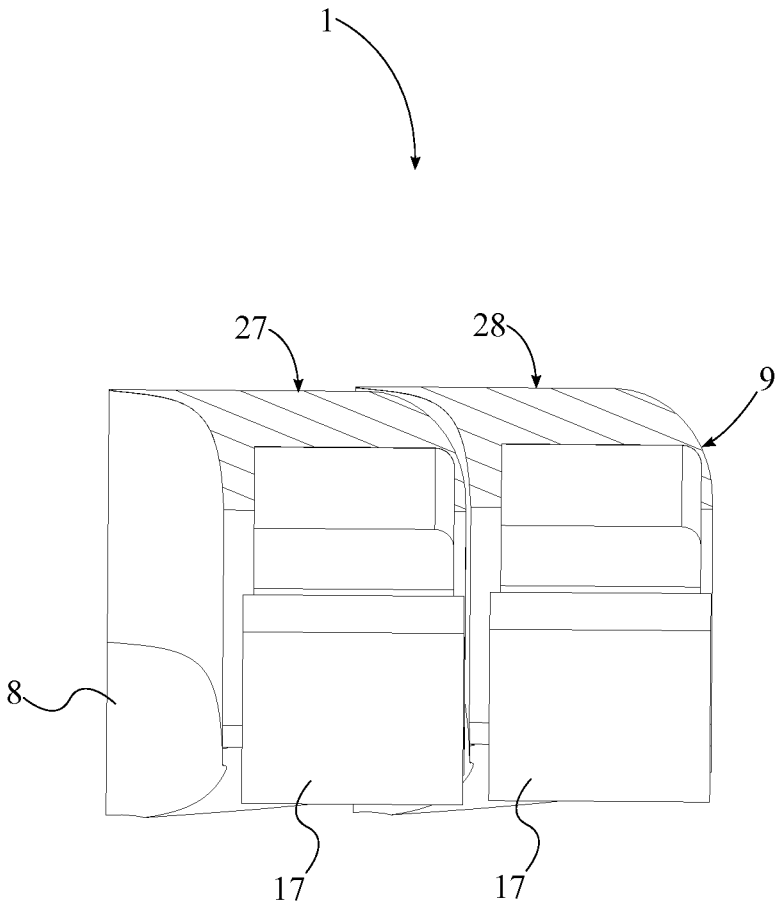
FIG. 6 is a sectional view about the section line A-A depicted in FIG. 5.

The receiving lip 8 is externally and adjacently connected to the buckle 2. In a similar fashion, the insertion lip 9 is externally and adjacently connected to the buckle 2, opposite to the receiving lip 8. The receiving lip 8 and the insertion lip 9 allow adjacent buckles to overlap and interlock with each other as seen in FIG. 6-7. More specifically, the series of fastening mechanisms 1 comprises an arbitrary mechanism 27 and a subsequent mechanism 28. The series of fastening mechanisms 1 is positioned such that the insertion lip 9 of the arbitrary mechanism 27 is conformedly engaged to the receiving lip 8 of the subsequent mechanism 28. This configuration yields little to no gaps in between the buckles, providing maximum protection for the foot of the user.

The series of fastening mechanisms 1 is equally distributed about the shoe upper, and aligned along the length of the tongue as seen in FIG. 7. The number of fastening mechanisms may vary depending on shoe type, design, shoe size, manufacturing tolerances, and other similar characteristics. As mentioned above, each fastening mechanism is attached to the shoe 31 through the mounting plate 17 and the engagement strip 21. To accommodate for the lateral curvature of the shoe 31, the mounting plate 17 and the engagement strip 21 are radially offset from each other. The location of the mounting plate 17 on the shoe upper is contingent on whether the shoe 31 is designed for the right foot or the left foot. It is preferred that the engagement strip 21 is positioned on the side of the shoe 31 coincident with the inside of the foot; and the mounting plate 17 be positioned on the side of the shoe 31 coincident with the outside of the foot. Various alternative configurations may also be utilized. In one embodiment, the positioning of the engagement strip 21 and mounting plate 17 may switch along the length of the tongue at certain increments. It is preferred the mounting plate 17 and the engagement strip 21 are integrated into the material of the shoe 31 during the design and manufacturing processes, similar to shoelaces and other securing systems.

Figure 4:
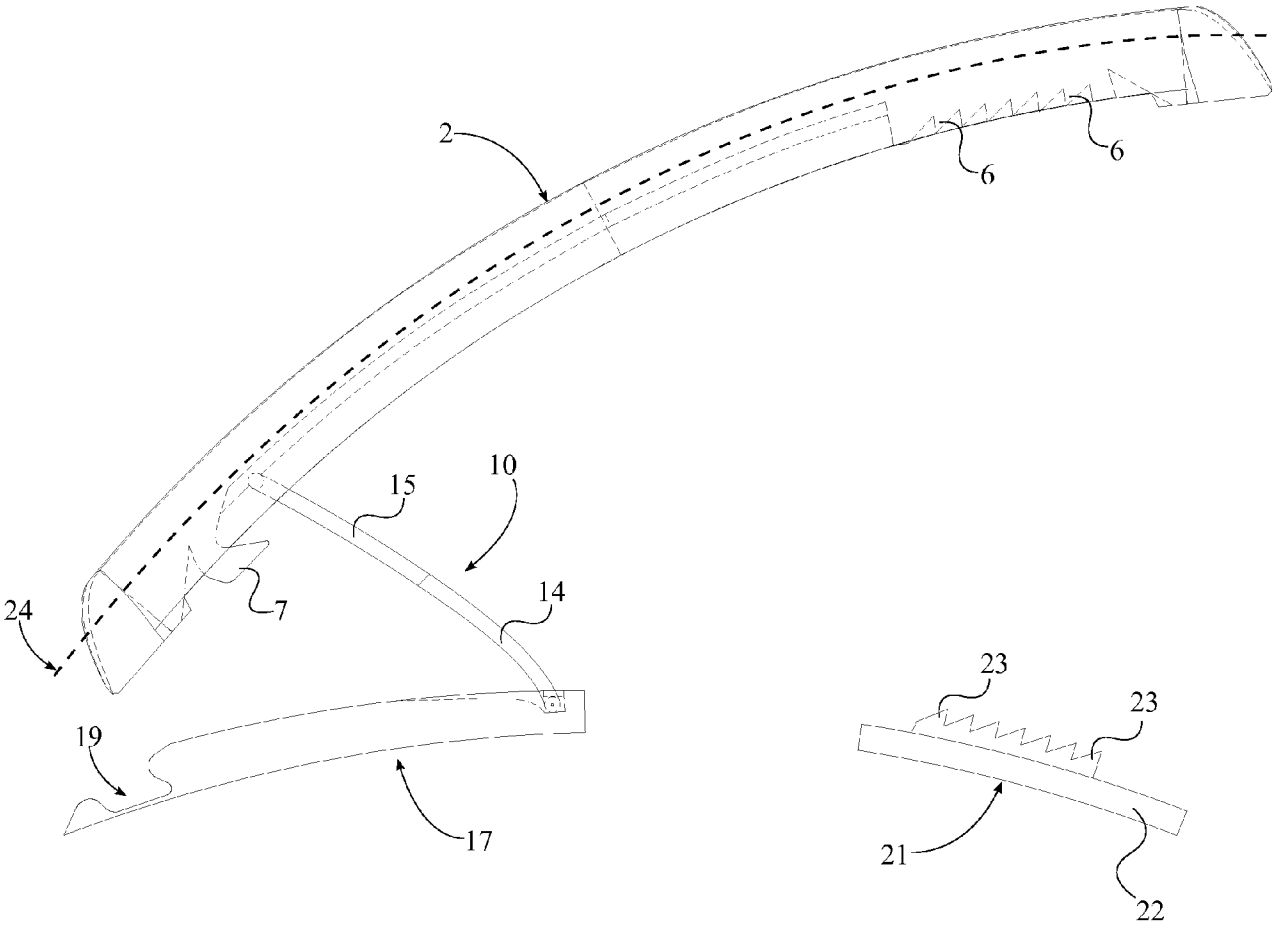
FIG. 4 is a front line view of the fastening mechanism in an unlocked configuration.
Figure 5:
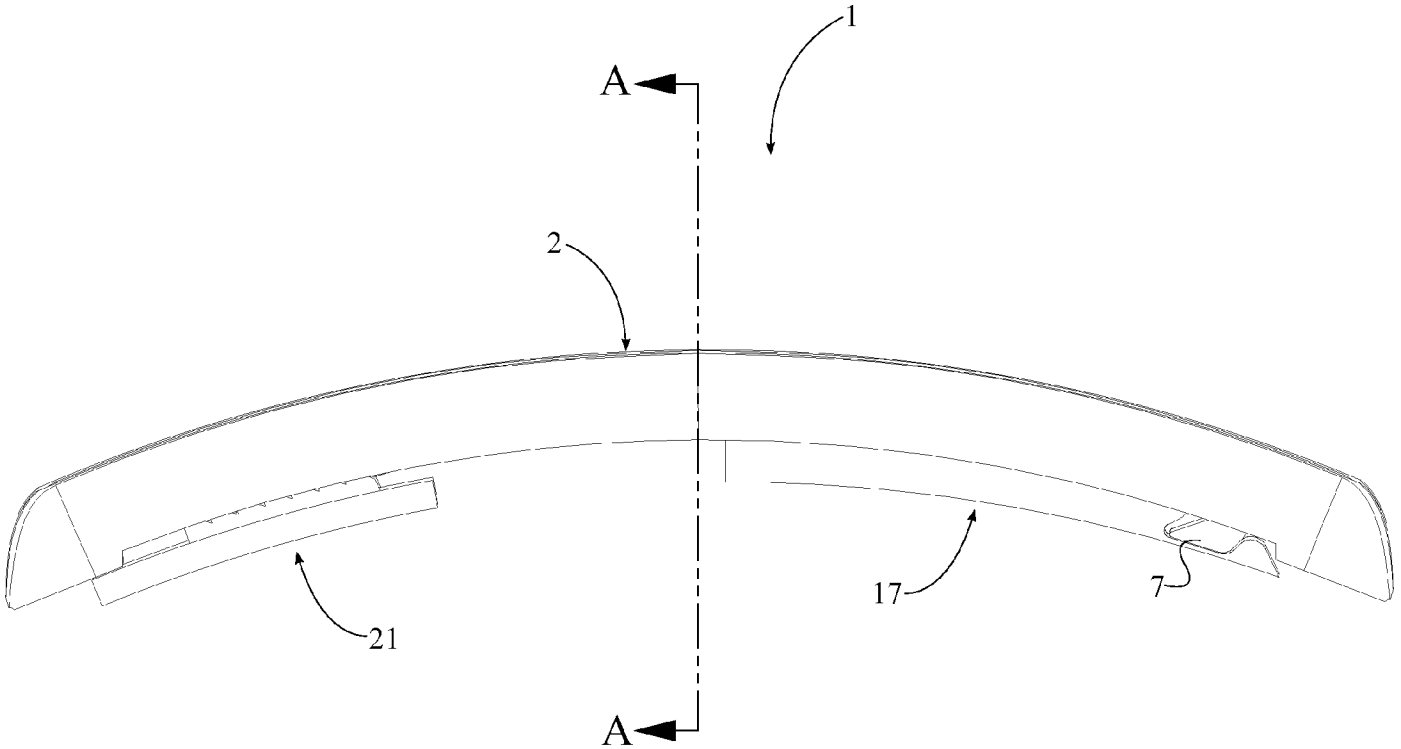
FIG. 5 is a rear view of a series of fastening mechanisms.

In relation to the mounting plate 17 and the engagement strip 21, the buckle 2 may be positioned in two configurations; an unlocked configuration and a locked configuration. The unlocked configuration, depicted in FIGS. 4-5, is the unfastened state of the buckle 2, which allows the user to slip his/her foot into the shoe 31 with ease. In the unlocked configuration the buckle 2 is removably attached to the mounting plate 17 by the pivot plate 10. More specifically, the second end 12 is pivotally engaged to the pivot-receiving cavity 18. The pivot-receiving cavity 18 is shaped to the outer dimensions of the second end 12 to allow for partial rotational motion. It is preferred the pivot plate 10 is removably attached to the pivot-receiving cavity 18 such that the buckle 2 and the pivot plate 10 may be removed from the shoe 31 completely. Additionally the pivot-receiving cavity 18 further contains two lateral lips which prevent the pivot plate 10 from disengaging the pivot-receiving cavity 18 when rotated clockwise during locking. This allows for each fastening mechanism to be attached and fastened to the shoe 31 individually with ease. In an alternative embodiment, the pivot plate 10 is pivotally connected to the pivot-receiving cavity 18 through a pin or a similar mechanism in which case the series of fastening mechanisms 1 will always be connected to the shoe 31 in either the locked configuration or the unlocked configuration; in the unlocked configuration the buckle 2 is free to move and rotate about the second end 12.

Figure 3:
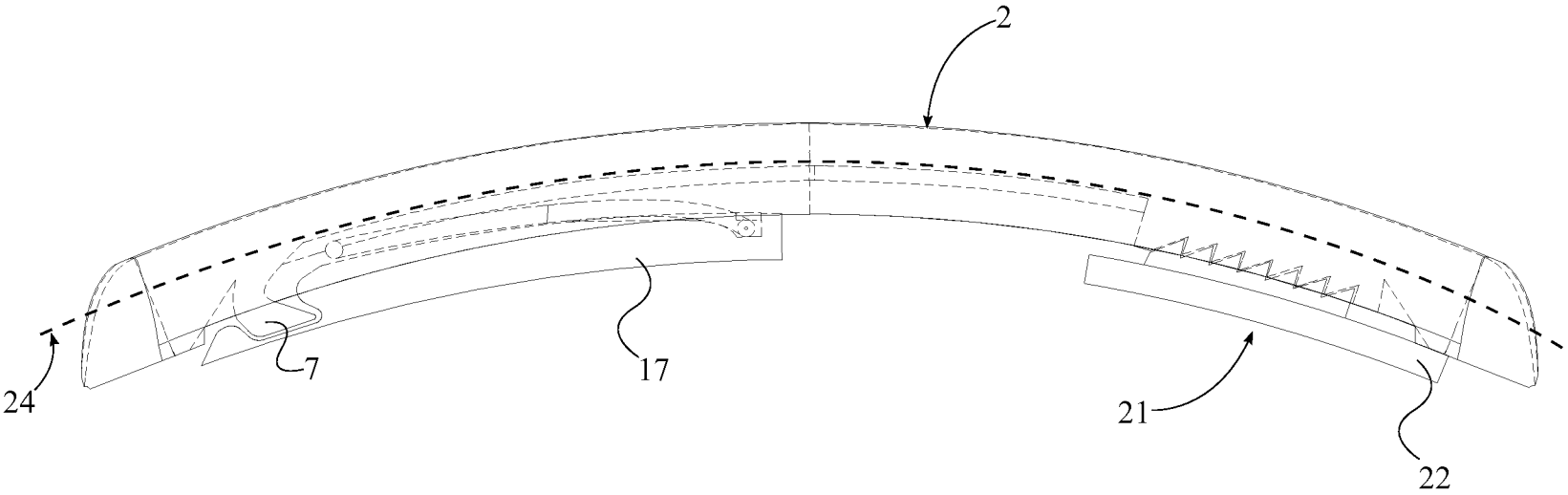
FIG. 3 is a front line view of the fastening mechanism in a locked configuration.

The locked configuration, depicted in FIG. 3, closes the fastening mechanism and in turn constricts the two sides of the shoe upper, affixing the shoe 31 to the foot of the wearer. In the locked configuration, the engagement strip 21 and the mounting plate 17 are affixed together by the buckle 2. The engagement strip 21 comprises a strip body 22 and a second plurality of teeth 23. The strip body 22 is integrated into the material of the shoe 31. The second plurality of teeth 23 is connected across the strip body 22. The number of individual teeth determines the adjustability of the fastening mechanism. An increased number of teeth will allow for a wider range of tightness that may be achieved by the fastening mechanism; and decreased number of teeth will decrease the range. The number of teeth may vary depending on customer requirements, shoe size, shoe type, and other similar attributes. Both the mounting plate 17 and the second plurality of teeth 23 are positioned into the first cavity 5. The buckle 2 is attached to the engagement strip 21 through the first plurality of teeth 6 being engaged to the second plurality of teeth 23. The buckle 2 is attached to the mounting plate 17 through the pivot plate 10 and the locking hook 7. The second end 12 is pivotably engaged to the pivot-receiving cavity 18; and the locking hook 7 is engaged to the keeper indentation 19.

To lock the fastening mechanism, the user first positions the second end 12 into the pivot-receiving cavity 18 and rotates the buckle 2 such that the first plurality of first teeth is directly adjacent to the engagement strip 21. Then, the user engages the first plurality of teeth 6 to the second plurality of teeth 23 and applies pressure onto the top of the buckle 2 to position the locking hook 7 adjacent to the keeper indentation 19, pulling the engagement strip 21 and the corresponding side of the shoe upper closer to the mounting plate 17. Finally, the user applies pressure onto the buckle 2 until the locking hook 7 snaps into the keeper indentation 19.

The pivot plate 10 couples the buckle 2 and the mounting plate 17 together and acts as a tensioner for the fastening mechanism. Referring to FIG. 1, the pivot plate 10 comprises an axle pin 16 and a flexible body 13. The axle pin 16 is a tubular extrusion with rounded ends allowing the pivot plate 10 to rotate within the pivot-receiving cavity 18. The flexible body 13 comprises a first portion 14 and a second portion 15. The axle pin 16 is connected adjacent to the first portion 14. The second portion 15 acts as an extender for the first portion 14 and is connected adjacent to the first portion 14, opposite to the axle pin 16. The first portion 14 is tapered from the second portion 15 to the axle pin 16 to facilitate a flush engagement with the mounting plate 17 in the locked configuration. To further ensure that the pivot plate 10 sits flush within the mounting plate 17, the mounting plate 17 further comprises a recessed space 20. The recessed space 20 traverses through the mounting plate 17 into the pivot-receiving cavity 18 and is shaped to receive the first portion 14 as seen in FIG. 1.

Figure 8:
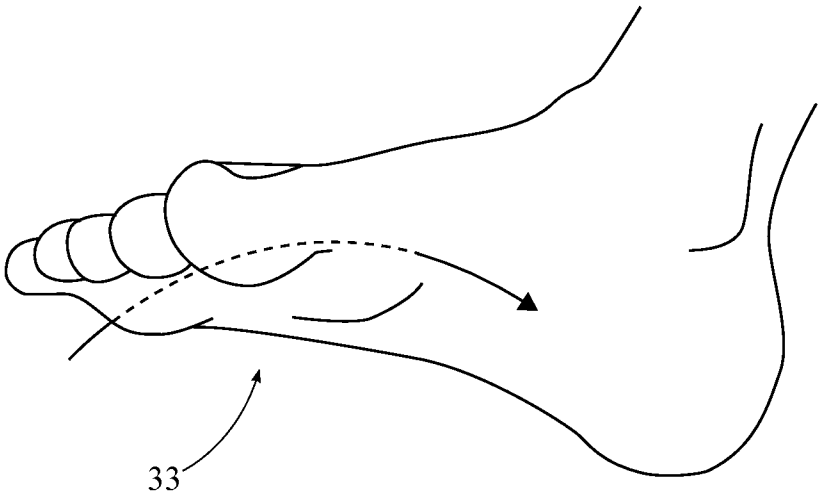
FIG. 8 is a perspective view of a foot.

To accommodate for the curvature of the foot and the ankle, the series of fastening mechanisms 1 comprises a first mechanism 25 and a set of ankle mechanisms 29. Additionally, the buckle 2 is designed to conform to the natural curvature of the foot, similar to the curvature of the shoe 31. The series of fastening mechanisms 1 is arranged along the length of the tongue, as described above, with the receiving lip 8 of each fastening mechanism facing a toe 34 of the shoe 31. The first mechanism 25 is positioned directly adjacent to the toe 34 and is first in the series of fastening mechanisms 1. A tapered filler 26 is used to close off the receiving lip 8 of the first mechanism 25 to provide adequate protection for the front of the foot. The tapered filler 26 is conformedly connected into the receiving lip 8 of the first mechanism 25. The set of ankle mechanisms 29 is positioned adjacent to an ankle portion 32 of the shoe 31, wherein each from the set of ankle mechanisms 29 comprises a gap-filling lip extension 30. The gap-filling lip extension 30 covers the gaps created in between adjacent fastening mechanisms due to the curvature change at the ankle. The gap-filling lip extension is thus connected adjacent to the receiving lip 8, opposite to the buckle 2 as seen in FIG. 7. The buckle 2 from each of the fastening mechanisms is also curved according to a definition axis 24 to accommodate for the lateral curvature of the top of the foot. The definition axis 24 centrally traverses along the buckle 2 from the locking hook 7 to the first plurality of teeth 6 and is curved about a transversal foot arch 33, depicted in FIG. 8. Because the fastening mechanisms are interlocked together, similar to a nested configuration, the user must fasten the shoe 31 in a certain order.

The order starts at the first mechanism 25 and continues sequentially one-by-one along the tongue of the shoe 31.

Although the invention has been explained in relation to its preferred embodiment, it is to be understood that many other possible modifications and variations can be made without departing from the spirit and scope of the invention as hereinafter claimed.

What is claimed is:

1. A fastening mechanism for ice skates comprises:
a series of fastening mechanisms;
each from the series of fastening mechanisms comprises a buckle, a receiving lip, an insertion lip, a pivot plate, a mounting plate, and an engagement strip;
the mounting plate comprises a pivot-receiving cavity and a keeper indentation;
the buckle comprises a top surface, a bottom surface, a first cavity, a first plurality of teeth, and a locking hook;
the pivot plate comprises a first end and a second end;
the first cavity traversing into the buckle from the bottom surface;
the plurality of teeth being positioned within the first cavity;
the locking hook being positioned within the first cavity;
the locking hook and the plurality of teeth being positioned opposite to each other along the buckle;
the receiving lip being externally and adjacently connected to the buckle;
the insertion lip being externally and adjacently connected to the buckle, opposite to the receiving lip;
the first end being pivotably attached within the first cavity, adjacent to the locking hook; and
the keeper indentation and the pivot-receiving cavity being positioned opposite to each other across the mounting plate.

2. The fastening mechanism for ice skates as claimed in claim 1 comprises:
wherein the buckle is in a locked configuration with the mounting plate and the engagement strip;
the engagement strip comprises a strip body and a second plurality of teeth;
the mounting plate and the engagement strip being radially offset from each other;
the second plurality of teeth being connected across the strip body;
the mounting plate and the second plurality of teeth being positioned into the first cavity;
the first plurality of teeth being engaged to the second plurality of teeth;
the second end being pivotally engaged to the pivot-receiving cavity; and
the locking hook being engaged to the keeper indentation.

3. The fastening mechanism for ice skates as claimed in claim 1 comprises:
the pivot plate further comprises a flexible body and an axle pin;
the mounting plate further comprises a recessed space;
the flexible body comprises a first portion and a second portion;
the recessed space traversing through the mounting plate into the pivot-receiving cavity;
the axle pin being connected adjacent to the first portion;
the second portion being connected adjacent to the first portion, opposite to the axle pin;
the first portion being tapered from the second portion to the axle pin; and
the recessed space being shaped to receive the first portion.

4. The fastening mechanism for ice skates as claimed in claim 1 comprises:
wherein the buckle is in an unlocked configuration with the mounting plate and the engagement strip;
the mounting plate and the engagement strip being radially offset from each other; and
the second end being pivotally engaged to the pivot-receiving cavity.

5. The fastening mechanism for ice skates as claimed in claim 1 comprises:
a definition axis for the buckle;
the definition axis centrally traversing along the buckle from the locking hook to the first plurality of teeth; and
the definition axis being curved about a transversal foot arch.

6. The fastening mechanism for ice skates as claimed in claim 1 comprises:
the series of fastening mechanisms comprises an arbitrary mechanism and a subsequent mechanism; and
the insertion lip of the arbitrary mechanism being conformedly engaged to the receiving lip of the subsequent mechanism.

7. The fastening mechanism for ice skates as claimed in claim 1 comprises:
a tapered filler;
the series of fastening mechanisms comprises a first mechanism, wherein the first mechanism is positioned adjacent to a toe of a shoe; and
the tapered filler being conformedly connected into the receiving lip of the first mechanism.

8. The fastening mechanism for ice skates as claimed in claim 1 comprises:
the series of fastening mechanisms comprises a set of ankle mechanisms, wherein the set of ankle mechanisms is positioned adjacent to an ankle portion of a shoe;
each from the set of the ankle mechanisms comprises a gap-filling lip extension; and
the gap-filling lip extension being connected adjacent to the receiving lip, opposite to the buckle.

9. A fastening mechanism for ice skates comprises:
a series of fastening mechanisms;
each from the series of fastening mechanisms comprises a buckle, a receiving lip, an insertion lip, a pivot plate, a mounting plate, and an engagement strip;
the mounting plate comprises a pivot-receiving cavity and a keeper indentation;
the buckle comprises a top surface, a bottom surface, a first cavity, a first plurality of teeth, and a locking hook;
the pivot plate comprises a first end and a second end;
the first cavity traversing into the buckle from the bottom surface;
the plurality of teeth being positioned within the first cavity;
the locking hook being positioned within the first cavity;
the locking hook and the plurality of teeth being positioned opposite to each other along the buckle;
the receiving lip being externally and adjacently connected to the buckle;
the insertion lip being externally and adjacently connected to the buckle, opposite to the receiving lip;
the first end being pivotably attached within the first cavity, adjacent to the locking hook;
the keeper indentation and the pivot-receiving cavity being positioned opposite to each other across the mounting plate;

the series of fastening mechanisms comprises an arbitrary mechanism and a subsequent mechanism; and the insertion lip of the arbitrary mechanism being conformedly engaged to the receiving lip of the subsequent mechanism.

10. The fastening mechanism for ice skates as claimed in claim 9 comprises:

wherein the buckle is in a locked configuration with the mounting plate and the engagement strip;

the engagement strip comprises a strip body and a second plurality of teeth;

the mounting plate and the engagement strip being radially offset from each other;

the second plurality of teeth being connected across the strip body;

the mounting plate and the second plurality of teeth being positioned into the first cavity;

the first plurality of teeth being engaged to the second plurality of teeth;

the second end being pivotally engaged to the pivot-receiving cavity; and the locking hook being engaged to the keeper indentation.

11. The fastening mechanism for ice skates as claimed in claim 9 comprises:

the pivot plate further comprises a flexible body and an axle pin;

the mounting plate further comprises a recessed space;

the flexible body comprises a first portion and a second portion;

the recessed space traversing through the mounting plate into the pivot-receiving cavity;

the axle pin being connected adjacent to the first portion;

the second portion being connected adjacent to the first portion, opposite to the axle pin;

the first portion being tapered from the second portion to the axle pin; and the recessed space being shaped to receive the first portion.

12. The fastening mechanism for ice skates as claimed in claim 9 comprises:

wherein the buckle is in an unlocked configuration with the mounting plate and the engagement strip;

the mounting plate and the engagement strip being radially offset from each other; and the second end being pivotally engaged to the pivot-receiving cavity.

13. The fastening mechanism for ice skates as claimed in claim 9 comprises:

a definition axis for the buckle;

the definition axis centrally traversing along the buckle from the locking hook to the first plurality of teeth; and the definition axis being curved about a transversal foot arch.

14. The fastening mechanism for ice skates as claimed in claim 9 comprises:

a tapered filler;

the series of fastening mechanisms comprises a first mechanism, wherein the first mechanism is positioned adjacent to a toe of a shoe; and the tapered filler being conformedly connected into the receiving lip of the first mechanism.

15. The fastening mechanism for ice skates as claimed in claim 9 comprises:

the series of fastening mechanisms comprises a set of ankle mechanisms, wherein the set of ankle mechanisms is positioned adjacent to an ankle portion of a shoe;

each from the set of the ankle mechanisms comprises a gap-filling lip extension; and the gap-filling lip extension being connected adjacent to the receiving lip, opposite to the buckle.

16. A fastening mechanism for ice skates comprises:

a series of fastening mechanisms;

each from the series of fastening mechanisms comprises a buckle, a receiving lip, an insertion lip, a pivot plate, a mounting plate, and an engagement strip;

the mounting plate comprises a pivot-receiving cavity and a keeper indentation;

the buckle comprises a top surface, a bottom surface, a first cavity, a first plurality of teeth, and a locking hook;

the pivot plate comprises a first end and a second end;

the first cavity traversing into the buckle from the bottom surface;

the plurality of teeth being positioned within the first cavity;

the locking hook being positioned within the first cavity;

the locking hook and the plurality of teeth being positioned opposite to each other along the buckle;

the receiving lip being externally and adjacently connected to the buckle;

the insertion lip being externally and adjacently connected to the buckle, opposite to the receiving lip;

the first end being pivotably attached within the first cavity, adjacent to the locking hook;

the keeper indentation and the pivot-receiving cavity being positioned opposite to each other across the mounting plate;

the series of fastening mechanisms comprises an arbitrary mechanism, a subsequent mechanism, and a set of ankle mechanisms, wherein the set of ankle mechanisms is positioned adjacent to an ankle portion of a shoe;

the insertion lip of the arbitrary mechanism being conformedly engaged to the receiving lip of the subsequent mechanism;

each from the set of the ankle mechanisms comprises a gap-filling lip extension; and the gap-filling lip extension being connected adjacent to the receiving lip, opposite to the buckle.

17. The fastening mechanism for ice skates as claimed in claim 16 comprises:

wherein the buckle is in a locked configuration with the mounting plate and the engagement strip;

the engagement strip comprises a strip body and a second plurality of teeth;

the mounting plate and the engagement strip being radially offset from each other;

the second plurality of teeth being connected across the strip body;

the mounting plate and the second plurality of teeth being positioned into the first cavity;

the first plurality of teeth being engaged to the second plurality of teeth;

the second end being pivotally engaged to the pivot-receiving cavity; and the locking hook being engaged to the keeper indentation.

18. The fastening mechanism for ice skates as claimed in claim 16 comprises:

the pivot plate further comprises a flexible body and an axle pin;

the mounting plate further comprises a recessed space;

the flexible body comprises a first portion and a second portion;

the recessed space traversing through the mounting plate into the pivot-receiving cavity;

the axle pin being connected adjacent to the first portion;

the second portion being connected adjacent to the first portion, opposite to the axle pin;

the first portion being tapered from the second portion to the axle pin; and the recessed space being shaped to receive the first portion.

19. The fastening mechanism for ice skates as claimed in claim 16 comprises:

wherein the buckle is in an unlocked configuration with the mounting plate and the engagement strip;

the mounting plate and the engagement strip being radially offset from each other; and the second end being pivotally engaged to the pivot-receiving cavity.

20. The fastening mechanism for ice skates as claimed in claim 16 comprises:

a definition axis for the buckle;

a tapered filler;

the definition axis centrally traversing along the buckle from the locking hook to the first plurality of teeth;

the definition axis being curved about a transversal foot arch;

the series of fastening mechanisms comprises a first mechanism, wherein the first mechanism is positioned adjacent to a toe of a shoe; and the tapered filler being conformedly connected into the receiving lip of the first mechanism.

* * * * *